United States Patent [19]

Agrawal

[11] Patent Number: 4,477,278

[45] Date of Patent: Oct. 16, 1984

[54] STEELMAKING PROCESS USING CALCIUM CARBIDE AS FUEL

[75] Inventor: Balkishan Agrawal, Ossining, N.Y.

[73] Assignee: Union Carbide Corporation, Danbury, Conn.

[21] Appl. No.: 456,113

[22] Filed: Jan. 6, 1983

[51] Int. Cl.³ ..... C21C 7/00

[52] U.S. Cl. ..... 75/51; 75/52; 75/58

[58] Field of Search ..... 75/51–58, 75/60

[56] References Cited

U.S. PATENT DOCUMENTS 4,036,635 7/1977 Klapdar ..... 75/51

*Primary Examiner*—Peter D. Rosenberg

*Attorney, Agent, or Firm*—Stanley Ktorides

[57] ABSTRACT

Calcium carbide is efficiently and safely employed to provide heat to a steel melt during subsurface refining by providing the steel melt with acidic component(s) and/or oxidizable component(s), which when oxidized will yield acidic components, in a amount sufficient to flux the products of calcium carbide oxidation, while insuring that the calcium carbide does not reside in the bath for more 5 minutes prior to the initiation of its oxidation.

20 Claims, 3 Drawing Figures

STEELMAKING PROCESS USING CALCIUM CARBIDE AS FUEL

TECHNICAL FIELD

This invention relates to the pneumatic refining of steel and more particularly to the pneumatic refining of steel wherein calcium carbide is employed as an auxiliary fuel.

Background Art

Often during the pneumatic refining of steel one desires to raise the bath temperature by the oxidation of melt components and a known procedure is the addition to the melt of oxidizable fuel elements. Two such fuel elements are aluminum and silicon. However these elements have a number of disadvantages such as a tendency of their acidic oxidized products to attack the refractory lining of a converter and to hinder the desulfurizing capacity of the slag thus requiring large lime additions, and also the fact that no gases are generating during their oxidation thus requiring increased sparging gas to be introduced to the melt.

A fuel which is believed to overcome many of these problems is calcium carbide. For example, the oxidized products of calcium carbide are essentially lime, carbon monoxide and carbon dioxide. The lime may protect the converter's basic lining and aids in desulfurization and the gases act to help sparge the melt. However, calcium carbide fueling has been practiced only to a limited extent because of the slow and inefficient release of heat which has been far below that believed achievable.

One suggested way to overcome the problems of calcium carbide fueling is to add the calcium carbide together with silicon carbide. While such a procedure may have some beneficial value in some situations, such as in a top-blown process, it is generally inadequate due to the low heat derived from the calcium carbide oxidation and because of such problems as inadequate fluxing of the oxidation products of calcium carbide, and also because of excess wear of the refractory lining.

A suggested way to achieve improved fuel value from calcium carbide is to inject continuously fine particles of calcium carbide into a melt with oxygen. However, such a process may be hazardous, requires additional expensive equipment, and is complicated and difficult to carry out especially when the refining process is a subsurface refining process such as the AOD process.

It is believed that a major reason for the low heat value obtained from calcium carbide is the difficulty in fluxing the products of calcium carbide oxidation thus causing a lime coating barrier to form between the yet unoxidized portion of the calcium carbide particle and the melt. This problem becomes more severe with increased calcium carbide particle size. When the products of calcium carbide oxidation are adequately fluxed this coating is continuously removed from the particle thus exposing fresh calcium carbide to the melt for oxidation. The problem of adequately fluxing the products of calcium carbide oxidation are ameliorated somewhat when a top-blown steel refining process is employed because such processes inherently generate a large amount of iron oxide which serves to flux the calcium carbide oxidation products. However, the problem of adequately fluxing the products of calcium carbide oxidation is quite severe if a subsurface pneumatic steel refining process is employed.

Furthermore, when a subsurface pneumatic steel refining process is employed it is quite difficult to oxidize adequately the calcium carbide which resides in the bath for a considerable time before sufficient oxygen can contact it and oxidize it. This problem may be somewhat reduced by injecting the calcium carbide into the melt together with oxygen but, as stated earlier, such a process may be hazardous and is quite complicated.

It is therefore desirable to provide a subsurface steel refining process which can employ calcium carbide as a fuel while substantially avoiding the drawbacks of calcium carbide fueling.

It is therefore an object of this invention to provide a process for the subsurface pneumatic refining of steel employing calcium carbide as auxiliary fuel which is relatively uncomplicated to carry out.

It is another object of this invention to provide a process for the subsurface pneumatic refining of steel employing calcium carbide as auxiliary fuel which will enable attainment of a high fuel value of the calcium carbide.

It is another object of this invention to provide a process for the subsurface pneumatic refining of steel employing calcium carbide as auxiliary fuel which will overcome the problem of inadequate fluxing of the products of calcium carbide oxidation.

It is yet another object of this invention to provide a process for the subsurface pneumatic refining of steel employing calcium carbide as auxiliary fuel wherein the wear of the refractory lining of the converter is minimized.

It is another object of this invention to provide a process for the subsurface pneumatic refining of steel employing calcium carbide as auxiliary fuel which contributes to desired sparging of the melt.

It is a further object of this invention to provide a process for the subsurface pneumatic refining of steel employing calcium carbide as auxiliary fuel wherein there is provided a slag which will adequately desulfurize the melt.

SUMMARY OF THE INVENTION

The above and other objects which will become obvious to one skilled in the art upon a reading of this disclosure are attained by the present invention one aspect of which comprises:

In a process of subsurface pneumatic refining of a steel melt wherein calcium carbide is oxidized to provide heat to the melt, the improvement comprising:

(a) providing a bath having dissolved in the melt oxidizable component(s) in an amount, when oxidized, to provide sufficient acidic component(s) to flux the products of the oxidation of calcium carbide provided to the melt in step (b);

(b) providing calcium carbide to the melt;

(c) providing oxygen to the melt to oxidize said oxidizable component(s) at a rate such that the time period that the bath contains both said oxidizable component(s) and calcium carbide provided to the melt in step (b) does not exceed about 5 minutes; and (d) after step (c), oxidizing the calcium carbide to provide heat to the melt.

Another aspect of the process of this invention is:

In a process of subsurface pneumatic refining of a steel melt wherein calcium carbide is oxidized to provide heat to the melt, the improvement comprising:

(a) providing a bath having a slag containing acidic component(s) in an amount sufficient to flux the products of the oxidation of calcium carbide provided to the melt in step (b);

(b) providing calcium carbide to the melt;

(c) oxidizing the calcium carbide provided to the melt in step (b) to provide heat to the melt wherein a time period of not more than 5 minutes elapses between step (b) and the initiation of the step (c).

The term "pneumatic refining", is used herein to mean a process wherein oxygen is introduced to a steel melt to oxidize components of the melt.

The term, "oxidizable component", is used herein to mean an element or compound whose oxidation is kinetically favored over calcium carbide under steelmaking conditions.

The term, "acidic component", is used herein to mean an element or compound which fluxes calcium carbide oxidation products.

The term, "flux", is used herein to mean to dissolve into the slag.

The term, "bath", is used herein to mean the contents inside a steelmaking vessel during refining and comprising a melt, which comprises molten steel and material dissolved in the molten steel, and a slag, which comprises material not dissolved in the molten steel.

DETAILED DESCRIPTION

Figure 1:
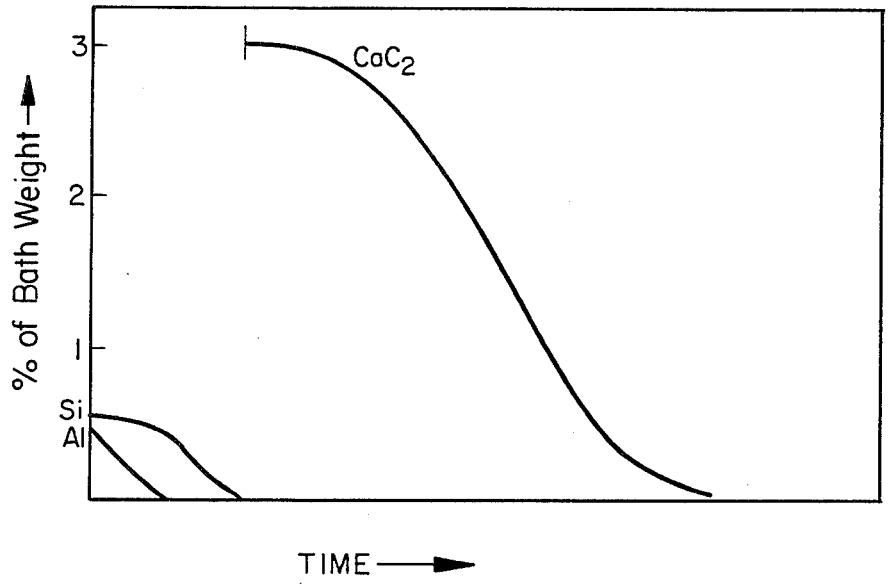
FIG. 1 is a graphical representation of concentrations of aluminum, silicon and calcium carbide in a bath during refining when calcium carbide is added subsequently to the oxidation of the aluminum and silicon.

The process of this invention is useful in any subsurface pneumatic steel refining process. Illustrative of subsurface refining processes wherein at least some of the oxygen required to refine the steel is provided to the melt from below the melt surface are the AOD, CLU, OBM, Q-BOP and LWS processes. Those skilled in the art are familiar with these steelmaking terms and with their meanings.

A particularly preferred pneumatic steel refining process is the argon oxygen decarburization process or AOD process which is a process for refining molten metals and alloys contained in a refining vessel provided with at least one submerged tuyere comprising (a) injecting into the melt through said tuyere(s) an oxygen-containing gas containing up to 90 percent of a dilution gas, wherein said dilution gas may function to reduce the partial pressure of the carbon monoxide in the gas bubbles formed during decarburization of the melt, alter the feed rate of oxygen to the melt without substantially altering the total injected gas flow rate, and/or serve as a protective fluid, and thereafter (b) injecting a sparging gas into the melt through said tuyere(s) said sparging gas functioning to remove impurities from the melt by degassing, deoxidation, volatilization or by flotation of said impurities with subsequent entrapment of reaction with the slag. Useful dilution gases include argon, helium, hydrogen, nitrogen, steam or a hydrocarbon. Useful sparging gases include argon, helium, nitrogen, carbon monoxide, carbon dioxide and steam. Useful protective fluids include argon, helium, hydrogen, nitrogen, carbon monoxide, carbon dioxide, steam and hydrocarbons. Argon and nitrogen are the preferred dilution and sparging gas. Argon, nitrogen and carbon dioxide are the preferred protective fluids.

In the process of this invention calcium carbide is provided to a bath which contains sufficient acidic components and/or oxidizable components, which when oxidized will yield sufficient acidic components, to flux adequately the products of calcium carbide oxidation, such as lime. In this way calcium carbide is continuously kept in contact with the steel melt and the oxidation of the calcium carbide is more efficiently carried out.

Among the oxidizable components suitable for use in the process of this invention one can name aluminum, silicon, ferrosilicon, titanium, ferroaluminum, ferrotitanium and the like. When such oxidizable components are used, it is important that they be added in such a manner so as to minimize slopping of the melt and damage to the converter refractory lining such as is taught in U.S. Pat. Nos. 4,187,102—Choulet et al and 4,278,464—Bury et al.

Among the acidic components suitable for use in the process of this invention one can name aluminum oxide, silicon dioxide, titanium dioxide, the oxidized forms of iron, and the like.

The preferred oxidizable components are aluminum and silicon and the preferred acidic components are aluminum oxide and silicon dioxide.

The amount of calcium carbide provided to the melt will depend on a number of factors such as the size of the melt, the bath chemistry and the tap temperature required. Those skilled in the art are familiar with such considerations. The amount of calcium carbide provided to the melt will, in turn, influence the amount of oxidizable and/or acidic components provided to the melt.

The calcium carbide may be added to the melt in one or more discreet additions or it may be continuously provided to the melt. It is preferable that the calcium carbide particles have a particle size of less than about one-half inch in diameter. If oxidizable components are required to be added to the melt they may be added either prior to or essentially simultaneously with the calcium carbide. A convenient way of making additions is to add both the calcium carbide and the oxidizable component(s) to the melt together preferably in a sealed container.

Figure 3:
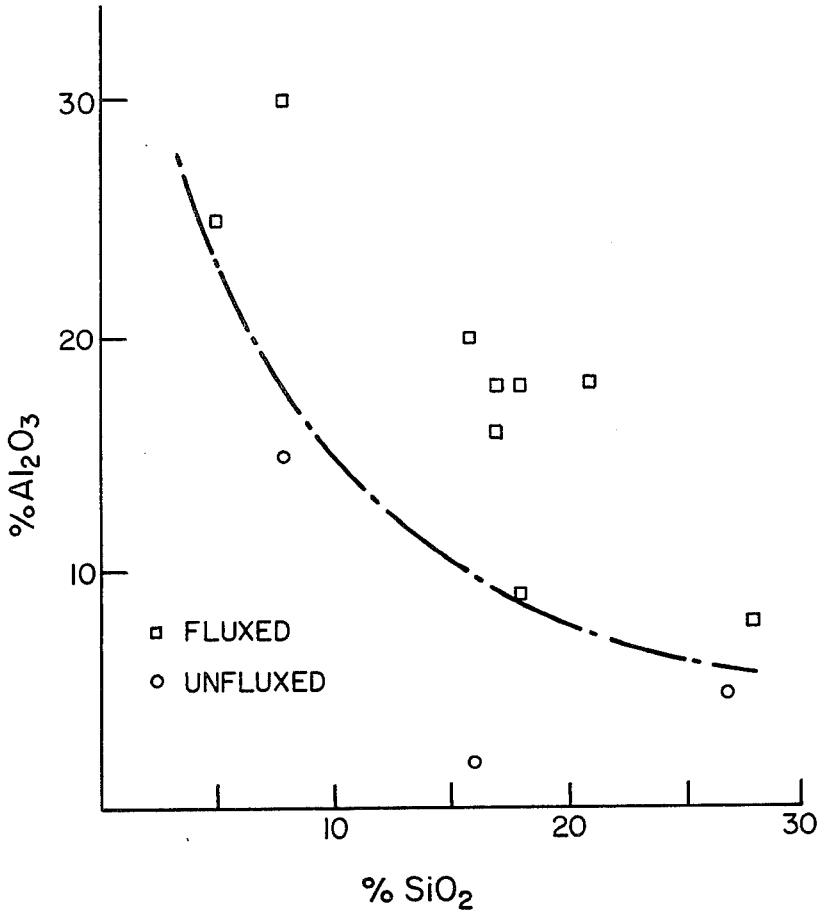
FIG. 3 is a graphical representation of the concentration of acidic components necessary to flux the calcium carbide oxidation products when $Al_2O_3$ and $SiO_2$ are used as the acidic components.

By providing a bath with sufficient oxidizable and/or acidic components to flux the calcium carbide oxidation products one now avoids the need to generate iron oxide to perform the fluxing and thus refines the melt more efficiently. Reference is made to FIG. 3 which is a graph of the concentration of aluminum oxide and silicon dioxide as a percentage of the slag on a normalized basis wherein the concentrations of aluminum oxide, silicon dioxide, lime and magnesium oxide equal 100 percent. On the graph the region below the curve represents concentrations of aluminum oxide and silicon dioxide which were not sufficient to flux the products of calcium carbide oxidation. Therefore, the minimum concentrations of aluminum oxide and silicon dioxide, which are the preferred acidic components, in the slag on a normalized basis, in order to carry out the process of this invention may be represented by the equation:

(percent $Al_2O_3$) (percent $SiO_2$) $\geqq 120$ where percent $Al_2O_3 \geqq 5$; percent $SiO_2 \geqq 3$ An important part of the process of this invention is that calcium carbide and the oxidizable component(s) coexist in the bath for no more than five minutes and preferably for no more than three minutes. The reason for the importance of this parameter may be more clearly explained with reference to FIG. 2 which shows the concentrations of aluminum, silicon and calcium carbide in a melt versus time for two discreet additions of each. As can be seen, in subsurface pneumatic refining aluminum, the easiest to oxidize of the three, oxidizes essentially completely before either of the other two begin to oxidize. When the aluminum has oxidized, then the silicon begins to oxidize and only after the silicon is essentially completely oxidized will the calcium carbide begin to oxidize. If the calcium carbide required by the melt were to reside in the melt for greater than five minutes before the initiation of its oxidation a very detrimental result would occur. It is believed that while residing in the bath under these steelmaking conditions the calcium component of the calcium carbide tends to volatize and be removed from the bath. Thus a significant part of the fuel value of the calcium carbide is lost because such calcium is now not available for oxidation to CaO. The longer the calcium carbide remains in the bath unreacted, the greater will be the loss of the fuel value of the calcium carbide. It is this volatilization of the calcium which has caused the heretofore puzzling tendency of calcium carbide to provide far less heat to the melt than would be theoretically predicted. The process of this invention significantly increases the amount of heat obtainable from calcium carbide by insuring that the calcium carbide does not reside for a long period unreacted in the bath.

In order to insure that the calcium carbide not reside in the bath while the oxidizable component(s) are being oxidized one could provide the entire amount of oxidizable component(s) to the bath and oxidize these components to provide the requisite acidic components. However, such a procedure is not preferred because the acidic components will tend to attack the converter lining unless products of calcium carbide oxidation are available for their neutralization. If the entire requisite amount of acidic components is in the bath prior to the initiation of calcium carbide oxidation, a large quantity of these acidic components will remain in the bath a long time before they can flux the calcium carbide oxidation products and thus may harm the converter lining.

A more preferable method of making the calcium carbide addition is as a series of discreet additions, each addition being no more than three weight percent of the bath, most preferably no more than two weight percent. Each calcium carbide addition is accompanied or preceded by the requisite amount of oxidizable and/or acidic components.

FIG. 1 shows in graphical form the results of one addition wherein calcium carbide is about three weight percent of the bath. In this embodiment the oxidizable components were added to the melt and completely oxidized prior to the calcium carbide addition. Thus in this embodiment the time that the calcium carbide and the oxidizable components are in the melt together is zero.

Figure 2:
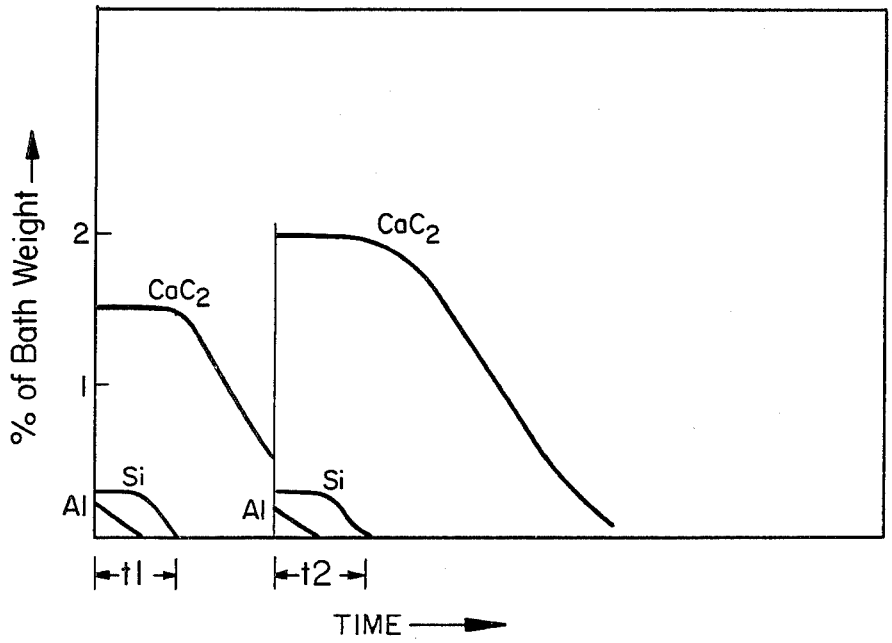
FIG. 2 is a graphical representation of concentrations of aluminum, silicon and calcium carbide in a bath during refining when calcium carbide is added to the bath simultaneously with the aluminum and silicon and there is made more than one addition.

FIG. 2 shows in graphical form the results of two additions of calcium carbide. In this embodiment each addition is about 1.5 weight percent of the bath and each calcium carbide addition is accompanied simultaneously by the requisite amount of oxidizable components, in this case aluminum and silicon. The time wherein the calcium carbide and the oxidizable components coexist in the melt is t1 or t2.

As can be appreciated the calcium carbide and oxidizable component additions may also be made continuously. If the calcium carbide is added continuously, the rate at which oxygen is provided to the melt to oxidize the oxidizable component(s) and the calcium carbide should be such to avoid a significant buildup of calcium carbide in the melt.

As has been described, the calcium carbide is kept from residing in the bath prior to initiation of its oxidation, while the oxidizable components are being oxidized, for more than 5 minutes by the provision to the melt of oxygen at a suitable rate and amount. Those skilled in the art are familiar with the stoichiometry and other considerations which will define the suitable oxygen flow rate and amount.

The additions to the melt may be initiated prior to, simultaneously with, or after the start of the oxygen flow, though no additions should be made after the oxygen flow has ceased.

It has been found that the addition of two different oxidizable components which are then oxidized to two different acidic components considerably increases the ease with which the calcium carbide oxidation products are fluxed and also significantly reduces the tendency of the melt to slop. While not wishing to be held to any theory, applicant believes such a beneficial result is due to a lowering of the melting point of the mixture of lime and acidic components with the increased number of different components of the mixture.

Now by the use of the process of this invention one can efficiently employ calcium carbide as fuel for a bottom blown steel refining process without the need to inject the calcium carbide into the melt together with the oxygen thus avoiding a potentially hazardous situation. With the process of this invention one gets remarkably efficient calcium carbide oxidation even though the calcium carbide and the oxygen may be provided to the melt at physically distant locations. Thus one is able to obtain the benefits of calcium carbide fueling, achieve greater heat value from the calcium carbide, while avoiding potentially hazardous operating conditions and significant damage to the refractory converter lining.

The following examples serve to further illustrate or compare the process of this invention. They are not intended to limit this invention in any way.

EXAMPLE 1

Into a 3-ton AOD converter was charged 6500 lbs of molten electric furnace low alloy steel having a temperature of 2845° F. Thereafter, were charged 20 lbs of aluminum, 28 lbs of 75 percent ferrosilicon and 80 lbs magnesium oxide and the melt was blown with 500 standard cubic feet of oxygen to oxidize the ferrosilicon and aluminum. Thereafter 200 lbs of commercial calcium carbide (containing about 80 percent calcium carbide with the remainder primarily lime) was added to the melt and the melt was blown with 1210 standard cubic feet of oxygen to oxidize the calcium carbide. After the calcium carbode oxidation the temperature of the melt was 265° F. hotter than it was when charged to the converter or about 103° F. per percent of calcium carbide based on the melt weight. The maximum theoretical heat gain is 187° F. per percent. The heat gain achieved in Example 1 was about 62 percent of the maximum. It is believed that such a large heat gain has never before been achieved for converters of this size and is comparable to a heat gain of more than 90 percent of the theoretical maximum for a 100-ton converter. After the calcium carbide oxidation step, the calcium carbide content in the slag was only 0.43 percent indicating virtually complete combustion of the calcium carbide. During the calcium carbide oxidation an oxygen-nitrogen mixture was used for 92 percent of the oxygen blow and an oxygen-argon mixture was used for the remaining 8 percent. The temperature increase attributable to calcium carbide oxidation is determined by accounting for heat loss such as due to lime additions, extra turndowns and alloying element additions, and heat gain due to oxidation of oxidizable components.

In a similar manner molten steel is charged to a converter but all the additions are made simultaneously. The oxygen is suppled at a rate such that the oxidizable components are oxidized in about 5 minutes. The calcium carbide is then oxidized. The heat gain is about 72° F. per percent calcium carbide.

In a similar manner, for comparative purposes, the above procedure is repeated except that oxygen is supplied at a rate such that the oxidizable components are oxidized in about 7 minutes, after which the calcium carbide is oxidized. The heat gain is only about 50° F. per percent calcium carbide. It is thus seen that the heat gain from calcium carbide oxidation drops percipitously when the calcium carbide resides in the bath for more than 5 minutes prior to initiation of its oxidation.

EXAMPLE 2

Into a 3-ton AOD converter was charged 6400 lbs of molten electric furnace low alloy steel having a temperature of 2900° F. Thereafter were charged 15 lbs of aluminum, 28 lbs of 75 percent ferrosilicon, 80 lbs of magnesium oxide and 200 lbs of commercial calcium carbide. The melt was blown with 1960 standard cubic feet of oxygen to oxidize the aluminum, ferrosilicon and calcium carbide. The calcium carbide was in the melt for 4.7 minutes prior to the initiation of its oxidation while the oxidizable components were being oxidized. A temperature increase for the melt of 210° F. or about 72° F. per percent calcium carbide was achieved.

In a similar manner, molten steel is charged to a converter but the additions are made in two steps. In the first step 7.5 lbs. of aluminum, 14 lbs of 75 percent ferrosilicon, 40 lbs. of magnesium oxide and 100 lbs. of commercial calcium carbide are added and the melt is blown with 980 standard cubic feet of oxygen to oxidize the aluminum, ferrosilicon and calcium carbide. The calcium carbide resides in the melt for about 2.5 minutes prior to initiation of its oxidation. The procedure is then repeated in the second step. The temperature increase for the melt is about 90° F. per percent of calcium carbide.

I claim:

1. In a process of subsurface pneumatic refining of a steel melt wherein calcium carbide is oxidized to provide heat to the melt, the improvement comprising:

(a) providing a bath having dissolved in the melt oxidizable component(s) in an amount, when oxidized, to provide sufficient acidic component(s) to flux the products of the oxidation of calcium carbide provided in the melt in step (b);

(b) providing calcium carbide to the melt;

(c) providing oxygen to the melt to oxidize said oxidizable component(s) at a rate such that the time period that the bath contains both said oxidizable component(s) and calcium carbide provided to the melt in step (b) does not exceed about 5 minutes; and (d) after step (c), providing gaseous oxygen to the melt to oxidize the calcium carbide to provide heat to the melt.

2. The process of claim 1 wherein said time period does not exceed about 3 minutes.

3. The process of claim 1 wherein said time period is essentially zero.

4. The process of claim 1 wherein the calcium carbide and the oxidizable component(s) are provided to the melt at about the same time.

5. The process of claim 1 wherein the oxidizable component(s) are provided to the melt prior to the addition of calcium carbide to the melt.

6. The process of claim 1 wherein the group of steps (a)–(d) is repeated at least once.

7. The process of claim 6 wherein the calcium carbide provided to the melt during each such group of steps does not exceed about 3 weight percent of the bath.

8. The process of claim 1 wherein the calcium carbide and the requisite amount of oxidizable component(s) are provided to the melt in a continuous addition.

9. The process of claim 1 wherein there are employed two different oxidizable components.

10. The process of claim 9 wherein said oxidizable components are aluminum and silicon.

11. The process of claim 10 wherein said acidic components are aluminum oxide and silicon dioxide.

12. The process of claim 11 wherein the amount of acidic components satisfies the relationship:

(percent $Al_2O_3$) (percent $SiO_2$)$\geqq$120 where percent $Al_2O_3 \geqq 5$ and percent $SiO_2 \geqq 3$, based on the normalized weight of the slag.

13. The process of claim 1 wherein the calcium carbide is provided to the melt physically distant from where the oxygen is provided to the melt.

14. The process of claim 13 wherein the calcium carbide is provided to the melt at the top of the melt.

15. The process of claim 1 wherein said subsurface pneumatic refining process is the AOD process.

16. In a process of subsurface pneumatic refining of a steel melt wherein calcium carbide is oxidized to provide heat to the melt, the improvement comprising:

(a) providing a bath having a slag containing acidic component(s) in an amount sufficient to flux the products of the oxidation of calcium carbide provided to the melt in step (b);

(b) providing calcium carbide to the melt;

(c) providing gaseous oxygen to the melt to oxidize the calcium carbide provided to the melt in step (b) to provide heat to the melt wherein a time period of not more than 5 minutes elapses between step (b) and the initiation of step (c).

17. The process of claim 16 wherein said time period is essentially zero.

18. The process of claim 16 wherein said acidic components are aluminum oxide and silicon dioxide.

19. The process of claim 16 wherein the calcium carbide is provided to the melt physically distant from where oxygen is provided to the melt to oxidize the calcium carbide.

20. The process of claim 16 wherein said subsurface pneumatic refining process is the AOD process.

* * * * *